United States Patent [19]

Dreisbach et al.

[11] Patent Number: 5,074,961

[45] Date of Patent: Dec. 24, 1991

[54] PROCESS FOR CONTROLLING PITCH DEPOSITION FROM PULP IN PAPERMAKING SYSTEMS

[75] Inventors: David D. Dreisbach; Gilbert S. Gomes, both of Jacksonville, Fla.

[73] Assignee: Betz Laboratories, Inc., Trevose, Pa.

[21] Appl. No.: 380,837

[22] Filed: Jul. 17, 1989

Related U.S. Application Data

[63] Continuation of Ser. No. 157,443, Feb. 17, 1988, abandoned, which is a continuation of Ser. No. 870,212, Jun. 3, 1986, Pat. No. 4,744,865.

[51] Int. Cl.[5] ..... D21D 3/00

[52] U.S. Cl. ..... 162/72; 162/168.1; 162/176; 162/177; 162/199; 162/DIG. 4

[58] Field of Search ..... 162/168.1, 72, 199, 162/DIG. 4, 76, 176, 177, 175

[56] References Cited

U.S. PATENT DOCUMENTS

| | | | |
|---|---|---|---|
| 3,081,219 | 3/1963 | Drennen et al. | 162/72 |
| 3,154,466 | 10/1964 | Nothum | 162/76 |
| 3,582,461 | 6/1971 | Lipowski et al. | 162/72 |
| 3,619,351 | 11/1971 | Kolosh | 162/72 |
| 3,748,220 | 7/1973 | Gard | 162/72 |
| 3,764,460 | 10/1973 | Miyamoto et al. | 162/5 |
| 3,992,249 | 11/1976 | Farley | 162/72 |
| 4,184,912 | 1/1980 | Payton | 162/72 |
| 4,190,491 | 2/1980 | Drennen et al. | 162/76 |
| 4,253,912 | 3/1981 | Becker et al. | 162/76 |
| 4,744,865 | 5/1988 | Dreisbach et al. | 162/168.1 |

FOREIGN PATENT DOCUMENTS

| | | | |
|---|---|---|---|
| 1197785 | 7/1970 | United Kingdom | 162/168.1 |

OTHER PUBLICATIONS

"Pulp and Paper", James P. Casey, vol. II, 2d ed., pp. 1096–1097.

"Pitch in Wood Pulps" *Pulp and Paper Magazine of Canada;* vol. 76, No. 5:70–77 (May 1975), pp. 4–10.

*Primary Examiner*—David A. Simmons
*Assistant Examiner*—Thi Dang
*Attorney, Agent, or Firm*—Alexander D. Ricci; Philip H. Von Neida

[57] ABSTRACT

The invention is a process for controlling pitch deposition from pulp in papermaking systems, by an effective amount of a polymer having methyl ether groups pendant to the backbone of the polymer to the pulp term "polymer". A preferred embodiment of the invention is controlling pitch deposition by adding an effective amount of a water soluble cellulose ether.

8 Claims, No Drawings

PROCESS FOR CONTROLLING PITCH DEPOSITION FROM PULP IN PAPERMAKING SYSTEMS

This is a continuation of application Ser. No. 07/157,443 filed Feb. 17, 1988, now abandoned, which in turn is a continuation of Ser. No. 06/870,212 filed June 3, 1986 (now U.S. Pat. No. 4,744,865).

BACKGROUND OF THE INVENTION

1. Field of the Invention

This invention relates to a process for controlling pitch deposition from pulp in papermaking systems.

2. Description of the Prior Art

Pitch deposition can be detrimental to efficient operation of paper mills. Pitch can deposit on process equipment in papermaking systems resulting in operational problems in the systems. Pitch deposits on consistency regulators and other instrument probes can render these components useless. Deposits on screens can reduce throughput and upset operation of the system. Deposition of the pitch can occur not only on metal surfaces in the system, but also on plastic and synthetic surfaces such as machining wires, felts, foils, uhle boxes and headbox components. Pitch deposits may also break off resulting in spots and defects in the final paper product which decrease the paper 's quality.

Surfactants, anionic polymers and copolymers of anionic monomers and hydrophobic monomers have been used extensively to prevent pitch deposition of metal soap and other resinous pitch components. See "Pulp and Paper", by James P. Casey, Vol. II, 2nd edition, pp. 1096–7. Bentoni, talc, diatomaceous silica, starch, animal glue, gelatin and alum are known to reduce pitch trouble. U.S. Pat. No. 3,081,219, Drennen et al., discloses the use of a polymeric N-vinyl lactam to control pitch in the making of paper for sulfite pulps. U.S. Pat. No. 3,154,466, Nothum, discloses the use of xylene sulfonic acid-formaldehyde condensates and salts thereof as pitch dispersants in papermaking. The use of napthalene sulfonic acid-formaldehyde condensates for pitch control is also known in the art. U.S. Pat. No. 3,582,461, Lipowski et al., teaches the use of water soluble dicyandiamide-formaldehyde condensates to control pitch. U.S. Pat. No. 3,619,351. Kolosh, discloses process and composition for controlling resin in aqueous cellulose pulp suspensions which comprises incorporating in the suspension a resin control agent comprising a certain water-soluble nonsurface-active cationic quaternary ammonium salt.

Additionally, U.S. Pat. No. 3,748,220, Gard, discloses the use of an aqueous solution of nitrilotriacetic acid sodium salt and a water soluble acrylic polymer to stabilize pitch in paper pulp. U.S. Pat. No. 3,992,249, Farley, discloses the use of certain anionic vinyl polymers carrying hydrophobic-oleophilic and anionic hydrophilic substituents when added prior to the beating operation in the range of about 0.5 part to 100 parts by weight of the polymer per million parts by weight of the fibrous suspension to inhibit the deposition of adhesive pitch particles on the surfaces of pulp-mill equipment. U.S. Pat. No. 4,184,912, Payton. discloses the use of a 3-component composition comprised of 50–20% by weight of a nonionic surfactant, 45–15% by weight of an anionic dispersant, and 45–15% by weight of an anionic polymer having molecular weight less than 100,000. U.S. Pat. No. 4,190,491, Drennan et al., discloses the use of a certain water-soluble linear cationic polymer having a viscosity average molecular weight of about 35,000 to 70,000. Also, U.S. Patent No. 4,253,912, Becker et al., discloses the use of a certain soluble, chlorine-resistant phosphonate of high calcium tolerance to disperse pitch contained in the aqueous medium of a pulp or papermaking process.

SUMMARY OF THE INVENTION

This invention relates to a process for controlling pitch deposition from pulp in papermaking systems which comprises adding to the pulp an effective amount of a polymer having methyl ether groups pendant to the backbone of the polymer. The polymer can be a water soluble homopolymer of methyl vinyl ether. The polymer can also be a water soluble copolymer derived from polymerizing methyl vinyl ether with nonionic hydrophilic monomers, anionic hydrophilic monomers and/or hydrophobic monomers, wherein the copolymer has at least 20 mol percent of methyl vinyl ether.

In another aspect, this invention comprises adding to the pulp an effective amount of a water soluble polymer derived by substituting methyl ether groups onto a preformed reactive polymer, such as polyvinyl alcohol or cellulose, wherein the water soluble polymer has from about 20 percent to about 100 percent of the available reactive groups of the preformed reactive polymer substitued with methyl ether groups. Preferably, the water soluble polymer is a water soluble cellulose ether. More preferably, the water soluble cellulose ether is selected from the group consisting of methyl cellulose, methyl hydroxyethyl cellulose, methyl hydroxypropyl cellulose, carboxymethyl methyl cellulose, and methyl hydroxybutyl methyl cellulose.

There are several advantages associated with the present invention as compared to prior art processes. These advantages include: an ability to function without being affected by the hardness of the water used in the system unlike certain anionics; an ability to function with lower foaming than surfactants; and an ability to function while not adversely affecting sizing, fines retention, or pitch retention.

DETAILED DESCRIPTION OF THE INVENTION

The present inventors have discovered that pitch deposition from pulp in papermaking systems can be controlled by adding to the pulp an effective pitch deposition control amount of a polymer having methyl ether groups pendant to the backbone of the polymer. By the term "pendant to the backbone", it is meant that the methyl ether groups are attached to the main polymer chain only through the oxygen of the methyl ether groups. Preferably, the polymer is water soluble.

In one embodiment, the polymers of this invention are derived or synthesized by polymerizing methyl vinyl ether either alone to form a homopolymer or in combination with one or more nonionic hydrophilic, anionic hydrophilic and/or hydrophobic monomers to form a copolymer having at least 20 mol percent of methyl vinyl ether. Preferably, the polymer has a molecular weight from about 5,000 to about 150,000.

Therefore, the polymers of the instant invention can be water soluble homopolymers of methyl vinyl ether. However, the polymers can also be water soluble copolymers derived from polymerizing methyl vinyl ether with hydrophobic monomers to form copolymers having at least 20 mol percent of methyl vinyl ether. Preferably, the copolymer has from about 0 mol percent to about 50 mol percent of recurring hydrophobic units. It is also preferred that the hydrophobic units of the copolymer are derived from monomers having from 2 to about 25 carbons. Exemplary hydrophobic monomers which may be effective in controlling pitch deposition when polymerized with methyl vinyl ether include vinyl acetate, propylene oxide, methacrylate, methyl ethacrylate, octadecylacrylate, n-octadecylacrylamide, styrene, methyl styrene, allyl stearate, vinyl stearate, ethene, propene, n-butene, isobutene, pentene, dodecene, octadecene, and vinyl ethers higher than methyl.

Additionally, the polymers of this invention can be water soluble copolymers derived from polymerizing methyl vinyl ether with nonionic hydrophilic monomers and/or anionic hydrophilic monomers to form copolymers having at least 20 mol percent of methyl vinyl ether. The polymer can have from about 0 mol percent to about 80 mol percent of recurring hydrophilic units. Preferably, the copolymer has a methyl vinyl ether mol percentage of greater than about 30%. Exemplary nonionic hydrophilic monomers which may be effective in controlling pitch deposition when polymerized with methyl vinyl ether include vinyl pyrolidone, ethylene oxide, and acrylamide. Exemplary anionic hydrophilic monomers include maleic anhydride, acrylic acid, methacrylate acid, maleic acid, itaconic acid, acrylamido acid, maleamic acid, and styrenesulfonic acid.

It is believed that effective copolymers of this invention can be formed having random distribution of the monomers, as well as various degrees of block formation and/or alternation within the polymer. By the term "block formation", it is meant that monomeric units of the same type tend to form regions in the polymer in exclusion of the other monomer. By the term "alternation", it is meant that the two monomers within the copolymer polymerize in such a manner that every other monomeric unit in the polymer is the same.

In another embodiment, the polymers of this invention are water soluble polymers derived by substituting methyl ether groups onto a preformed or pre-existing reactive polymer wherein the water soluble polymer has from about 20% to about 100% of the available reactive groups of the preformed or pre-existing polymer substituted with methyl ether groups. The term "preformed" or "pre-existing reactive polymer" means a polymer of either synthetic or natural origin which may be reacted to add methyl ether groups to its structure via methods known to those skilled in the art. Examples of suitable preformed reactive polymers include polyvinyl alcohol, polyvinyl acetate, cellulose, and various carbohydrates such as starch, galatomanan, galactoglucomanan, xylan, arabinogalactan and chitan. "Available reactive groups" means any group on a preformed reactive polymer which may be used to incorporate methyl ether groups into the polymer via reaction mechanisms known to those skilled in the art.

The available reactive groups of the preformed polymer can also be substituted with other hydrophilic and/or hydrophobic groups which allow for water solubility of the polymer. The polymer can be derived by substituting hydrophobic groups along with the methyl ether groups onto a suitable preformed reactive polymer to form a water soluble polymer having from about 0 mol percent to about 50 mol percent of the available reactive groups substituted with hydrophobic groups. Preferably, the hydrophobic groups have from 2 to about 25 carbons and are linked to the polymer by ether, ester, amine, amide, carbon-carbon or other suitable bond types. Preferred hydrophobic groups include: hydroxypropyl, hydroxybutyl, acetate, and ethers and esters having 2 to 16 carbons. Similarly, the polymer can be derived by substituting hydrophilic groups along with the methyl ether groups onto a suitable preformed reactive polymer to form a water soluble polymer having from about 0 mol percent to about 80 mol percent of the available reactive groups substituted with hydrophilic groups. Preferred hydrophilic groups include hydroxyl, carboxyl, sulfonic, pyrolidone, ethoxy, amide and polyethylene oxy groups. It is further believed that the polymers of this invention having methyl ether groups pendant to the backbone may have both hydrophobic and hydrophilic substitutions in the same polymer and still be effective for controlling pitch deposition. Examples of such polymers include hydroxybutyl methyl celluloses and hydroxypropyl methyl celluloses which have hydroxyl groups.

Preferably, the water soluble polymer is a water soluble cellulose ether. More preferably, the water soluble cellulose ether is selected from the group consisting of methyl cellulose, methyl hydroxyethyl cellulose, methyl hydroypropyl cellulose, carboxymethyl methyl cellulose, and methyl hydroxybutyl methyl cellulose. It is further preferred that the polymer is a water soluble methyl cellulose having a degree of substitution from 1.5 to 2.4. By. the term "degree of substitution from 1.5 to 2.4", it is meant that on the average for the polymer, 1.5 to 2.4 of the 3.0 available reactive hydroxyl groups of the anhydro glucose units of the cellulose are modified to methyl ether groups. Most preferably, the methyl cellulose polymer has a molecular weight from about 5,000 to about 150,000. The methyl cellulose polymer can also have hydroxyethyl, hydroxypropyl, carboxymethyl, and hydroxybutyl groups in addition to methyl ether and hydroxyl groups.

The polymers of the instant invention are effective in controlling pitch deposition in papermaking systems, such as Kraft, acid sulfite, and groundwood papermaking systems. For example, pitch deposition in the brown stock washer, screen room and decker systems in Kraft papermaking processes can be controlled. The term "papermaking system" is meant to include all pulp processes. Generally, it is thought that these polymers can be utilized to prevent pitch deposition on all wetted surfaces from the pulp mill to the reel of the paper machine under a variety of pH's and conditions. More specifically, these polymers effectively decrease the deposition of metal soap and other resinous pitch components not only on metal surfaces, but also on plastic and synthetic surfaces such as machine wires, felts, foils, uhle boxes and headbox components.

The polymers of the present invention can be added to the pulp at any stage of the papermaking system. The polymers can be added in dry particulate form or as dilute aqueous solution. The effective amount of these polymers to be added depends on the severity of the pitch problem which often depends on a number of variables, including the pH of the system, hardness, temperature, and the pitch content of the pulp. Generally between 0.5 ppm and 150 ppm of the polymer is added based on the weight of the pulp slurry.

The invention will be further illustrated by the following examples which are included as being illustrations of the invention and should not be construed as limiting the scope thereof.

EXAMPLES

It was found that pitch could be made to deposit from a 0.5% consistency fiber slurry containing approximately 2000 ppm of a laboratory pitch by placing the slurry. into a metal pan suspended in a laboratory ultrasonic cleaner water bath. The slurry. contained 0.5% bleached hardwood kraft fiber, approximately 2000 ppm of a fatty acid blend as the potassium salt, approximately 500 ppm calcium expressed as calcium carbonate from calcium chloride and approximately 300 ppm sodium carbonate. The slurry was maintained at 50° C. and a pH of 11.0. It was stirred gently by an overhead stirrer and subjected to ultrasonic energy for 10 minutes. The deposit was determined by the difference between the starting weight of the metal pan and the oven dried weight of the pan plus the deposit after the completion of test. Results are reported in Table I.

TABLE I

| Treatment | Deposit Weight |
|---|---|
| Control. | 686 mg |
| 50 ppm Polymethylvinyl ether | 68.6 mg |
| 50 ppm Polymethylvinyl ether/maleic anhydride copolymer | 41 mg |
| 50 ppm Hydroxypropyl Methylcellulose, 15 milipascal-seconds 2% solution at 20° C., 10,000 MW | 22 mg |
| 50 ppm Methylcellulose, 15 milipascal-seconds 2% solution at 20° C., 10,000 MW | 26 mg |
| 50 ppm Methylcellulose, 1500 milipascal-seconds 2% solution at 20° C., 63,000 MW | 1 mg |
| 50 ppm Methylcellulose, 4000 milipascal-seconds 2% solution at 20° C., 86,000 MW | 0 mg |

The results shown in Table I demonstrate that polymers in accordance with this invention are effective in controlling pitch deposits from pulp in a test designed to simulate brown stock washer/screen room Kraft pitch deposition. These results further indicate that the polymers are effective in controlling pitch deposition on metal surfaces and under alkaline conditions.

Additionally it was found that pitch having a composition similar to that of Southern pine extractables could be made to deposit from a 0.5% consistency pulp slurry containing 350 ppm pitch onto a plastic surface by stirring the slurry at a high rate using a blender. The slurry contained 0.5% bleached hardwood Kraft fiber, approximately 350 ppm pitch having fatty. acids, resin acids, fatty esters and sterols in the approximate ratio of Southern pine extractables and 200 ppm calcium expressed as calcium derived from calcium chloride. The slurry. was maintained at a pH of 4.0. A plastic coupon was fashioned and attached to the metal blender base. The pulp slurry was added to the blender and stirred for 5 minutes. The plastic coupon was then air dried and the deposit was determined by the difference between the clean and deposit laden weight of the plastic coupon. The results are reported in Table II.

TABLE II

| Treatment | *% Control of Deposit |
|---|---|
| 1 ppm Methylcellulose, 15 milipascal-seconds 2% solution at 20° C., 10,000 MW | 88% |
| 1 ppm Methylcellulose, 4,000 milipascal-seconds 2% solution at 20° C., 86,000 MW | 93% |
| 1 ppm Hydroxypropylmethylcellulose, 5 milipascal-seconds 2% solution at 20° C., 5,000 MW | 74% |

TABLE II-continued

| Treatment | *% Control of Deposit |
|---|---|
| 1 ppm Hydroxypropylmethylcellulose, 4,000 milipascal-seconds 2% solution at 20° C., 86,000 MW | 85% |
| 1 ppm Hydroxybutylmethylcellulose, 100 milipascal-seconds 2% solution at 20° C., 26,000 MW | 88% |

$$*\% \text{ Control of Deposit} = \frac{(\text{Untreated wt.}) - (\text{Treated wt.})}{(\text{Untreated wt.})} \times 100$$

The results reported in Table II indicate that polymers of this invention are effective in preventing pitch deposition on plastic surfaces. These results further indicate that the polymers may be effectively utilized under acidic conditions which might occur during any acid fine, linerboard, and groundwood papermaking operation.

Tests were also conducted to study pitch retention. The pitch solution and fiber for addition were prepared as described in the procedure for Table I. However, rather than using an ultrasound, the diluted slurry was added to a beaker. A stirrer was then connected and the contents stirred for 10 minutes. Then the slurry was dumped from the beaker into a Buchner funnel with machine wire in the bottom. Water was allowed to drain under gravity and then the full vacuum was pulled on the pulp pad. The pad was soxhlet extracted to determine the soluble organic content. Results are reported in Table III.

TABLE III

| Treatment | % Soluble Organics in Pulp Pad |
|---|---|
| Set A | |
| Control 1 (untreated) | 3.2% |
| Control 2 (untreated) | 3.0% |
| Methylcellulose, 1500 milipascal-seconds | 19.0% |
| Polymethylvinyl ether | 3.8% |
| Set B | |
| Control | 1.9% |
| Methylcellulose, 15 milipascal-seconds | 26.0% |
| Hydroxypropyl Methylcellulose, 15 milipascal-seconds | 21.0% |
| Methylcellulose, 15 milipascal-seconds | 26.0% |

The results reported in Table III indicate that water-soluble cellulose ethers flocculate and retain pitch, and that the polymethylvinyl ether has little negative effect on pitch retention.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

What is claimed is:

1. A process for controlling pitch deposition from pulp in papermaking systems wherein said pitch deposition is a problem which comprises adding a water soluble cellulose ether in an amount of about 0.5 ppm to about 150 ppm based on the weight of the pulp slurry to the pulp to control the pitch deposition from pulp in papermaking systems.

2. The process of claim 1 wherein said water soluble cellulose ether is selected from the group consisting of methyl cellulose, methyl hydroxyethyl cellulose, methyl hydroxypropyl cellulose, carboxymethyl methyl cellulose, and methyl hydroxybutyl methyl cellulose.

3. The process of claim 2 wherein said water soluble cellulose ether is water soluble methyl cellulose having a degree of substitution from 1.5 to 2.4.

4. The process of claim 3 wherein the water soluble methyl cellulose has a molecular weight from about 5,000 to about 150,000.

5. A process for controlling pitch deposition from pulp in papermaking systems wherein said pitch deposition is a problem which comprises adding to the pulp a water soluble polymer in an amount of about 0.5 ppm to about 150 ppm based on the weight of the pulp slurry to control pitch deposition from pulp in papermaking systems wherein said water soluble polymer is derived by substituting methyl ether groups into a preformed reactive polymer, and wherein said preformed reactive polymer is cellulose and said water soluble polymer has from about 22% to about 100% of available reactive groups of the preformed reactive polymer substituted with methyl ether groups.

6. The process of claim 5 wherein the water soluble polymer further has up to about 80 mol percent of the available reactive groups substituted with hydrophilic groups.

7. The process of claim 5 wherein the water soluble polymer further has up to about 50 mol percent of the available reactive groups substituted with hydrophobic groups.

8. The process of claim 7 wherein the hydrophobic groups have from about 2 to about 25 carbons.

* * * * *